US012680387B1

(12) United States Patent
Hofacker et al.

(10) Patent No.: US 12,680,387 B1
(45) Date of Patent: Jul. 14, 2026

(54) MODULAR DOWNHOLE TOOL SYSTEMS WITH INTEGRATED HYDRAULIC-ELECTRIC ACTUATION AND INTELLIGENT FLOW CONTROL FOR COILED TUBING OPERATIONS

(71) Applicant: Schlumberger Technology Corporation, Sugar Land, TX (US)

(72) Inventors: Mark Hofacker, Sugar Land, TX (US); Jeffrey Conner McCabe, Sugar Land, TX (US); Mark Callister Oettli, Sugar Land, TX (US); Pierre Ramondenc, Petaling Jaya (MY); Christian Robert Keppeler, Sugar Land, TX (US); Richard Morrison, Sugar Land, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 19/318,776

(22) Filed: Sep. 4, 2025

(51) Int. Cl.

| | |
|---|---|
| ***E21B 23/00*** | (2006.01) |
| ***E21B 4/00*** | (2006.01) |
| ***E21B 4/02*** | (2006.01) |
| ***E21B 4/16*** | (2006.01) |
| ***E21B 21/08*** | (2006.01) |
| ***E21B 21/14*** | (2006.01) |

(52) U.S. Cl.
CPC ..... *E21B 4/16* (2013.01); *E21B 4/006* (2013.01); *E21B 4/02* (2013.01); *E21B 21/08* (2013.01); *E21B 21/14* (2013.01)

(58) Field of Classification Search
CPC ..... E21B 23/00
See application file for complete search history.

(56) References Cited

U.S. PATENT DOCUMENTS 4,378,051 A * 3/1983 Cholet ..... E21B 23/00 166/383
5,887,654 A * 3/1999 Edwards ..... E21B 23/042 166/381
5,955,666 A * 9/1999 Mullins ..... E21B 43/14 340/853.2

(Continued)

OTHER PUBLICATIONS

Ramondenc, P. et al., "How a New On-Command Downhole Control System ?is Breaking the Efficiency and Sustainability Paradigm in Multilateral Stimulations", SPE-218731-MS, presented at the SPE/ICoTA Well Intervention Conference and Exhibition, The Woodlands, Texas, USA, 2024, 13 pages.

*Primary Examiner* — Kenneth L Thompson
(74) *Attorney, Agent, or Firm* — Jeffrey D. Frantz

(57) ABSTRACT

A system includes a downhole tool string having a downhole well tool configured to perform one or more downhole well operations of a well system, and at least one modular actuator module mechanically coupled to the downhole well tool. The at least one modular actuator module is configured to be removably decoupled from the downhole well tool to enable interchangeability with other modular actuator modules. In addition, the at least one modular actuator module is configured to provide on-command actuation for the downhole well tool based on control signals received from a surface processing system located at a surface location of the well system to enable the downhole well tool to perform the one or more downhole well operations of the well system.

17 Claims, 11 Drawing Sheets

(56) References Cited

U.S. PATENT DOCUMENTS

| | | | | |
|---|---|---|---|---|
| 8,540,021 | B2 * | 9/2013 | McCarter | E21B 43/14 166/242.6 |
| 9,097,100 | B2 | 8/2015 | Finke | |
| 9,416,638 | B2 | 8/2016 | Zhou | |
| 9,765,575 | B2 | 9/2017 | Hradecky | |
| 9,885,233 | B2 | 2/2018 | Wayne | |
| 10,006,282 | B2 | 6/2018 | Livescu | |
| 10,323,407 | B1 | 6/2019 | Robinson | |
| 10,323,507 | B2 | 6/2019 | Wayne | |
| 10,385,680 | B2 | 8/2019 | Livescu | |
| 10,584,563 | B2 | 3/2020 | Richards | |
| 10,876,377 | B2 | 12/2020 | Quero | |
| 10,927,627 | B2 | 2/2021 | Eitschberger | |
| 11,156,059 | B2 * | 10/2021 | Arsalan | E21B 47/13 |
| 11,255,147 | B2 | 2/2022 | Eitschberger | |
| 11,480,017 | B2 * | 10/2022 | Huxtable | E21B 17/023 |
| 11,952,861 | B2 | 4/2024 | Hofacker | |
| 11,993,991 | B2 | 5/2024 | Hofacker | |
| 12,270,277 | B2 | 4/2025 | Urdaneta | |
| 2017/0260834 | A1 | 9/2017 | Chacon | |
| 2019/0020538 | A1 | 1/2019 | Izenberg | |
| 2019/0178045 | A1 | 6/2019 | Frazier | |
| 2020/0182012 | A1 * | 6/2020 | Cecconi | E21B 43/1185 |

* cited by examiner

MODULAR DOWNHOLE TOOL SYSTEMS WITH INTEGRATED HYDRAULIC-ELECTRIC ACTUATION AND INTELLIGENT FLOW CONTROL FOR COILED TUBING OPERATIONS

BACKGROUND

The present disclosure generally relates to modular downhole tool systems utilizing modular actuator modules configured to provide on-command actuation for downhole well tools.

This section is intended to introduce the reader to various aspects of art that may be related to various aspects of the present techniques, which are described and/or claimed below. This discussion is believed to be helpful in providing the reader with background information to facilitate a better understanding of the various aspects of the present disclosure. Accordingly, it should be understood that these statements are to be read in this light, and not as an admission of any kind.

Current downhole operations in coiled tubing and well interventions are limited by tool complexity, lack of modularity, and inefficient control systems. These limitations hinder adaptability, increase operational time, and reduce the effectiveness of interventions in complex well environments.

SUMMARY

This summary is provided to introduce a selection of concepts that are further described below in the detailed description. This summary is not intended to identify key or essential features of the claimed subject matter, nor is it intended to be used as an aid in determining or limiting the scope of the claimed subject matter as set forth in the claims.

In certain embodiments, a downhole tool string includes a downhole well tool configured to perform one or more downhole well operations of a well system. The downhole tool string also includes at least one modular actuator module mechanically coupled to the downhole well tool. The at least one modular actuator module is configured to be removably decoupled from the downhole well tool to enable interchangeability with other modular actuator modules. In addition, the at least one modular actuator module is configured to provide on-command actuation for the downhole well tool based on control signals received from a surface processing system located at a surface location of the well system to enable the downhole well tool to perform the one or more downhole well operations of the well system.

In addition, in certain embodiments, a downhole well tool includes at least one modular actuator module mechanically coupled to the downhole well tool. The at least one modular actuator module is configured to be removably decoupled from the downhole well tool to enable interchangeability with other modular actuator modules. In addition, the at least one modular actuator module is configured to provide on-command actuation for the downhole well tool based on control signals received from a surface processing system located at a surface location of a well system to enable the downhole well tool to perform one or more downhole well operations of the well system.

In addition, in certain embodiments, a downhole tool string includes a downhole well tool configured to perform one or more downhole well operations of a well system. The downhole tool string also includes a plurality of modular actuator modules mechanically coupled to the downhole well tool and stacked along an axial length of the downhole well tool. Each modular actuator module of the plurality of modular actuator modules is configured to be removably decoupled from the downhole well tool to enable interchangeability with other modular actuator modules. In addition, each modular actuator module of the plurality of modular actuator modules is configured to provide both pressure control and mechanical shifting actuation for the downhole well tool based on control signals received from a surface processing system located at a surface location of the well system to enable the downhole well tool to perform the one or more downhole well operations of the well system.

Various refinements of the features noted above may be undertaken in relation to various aspects of the present disclosure. Further features may also be incorporated in these various aspects as well. These refinements and additional features may exist individually or in any combination. For instance, various features discussed below in relation to one or more of the illustrated embodiments may be incorporated into any of the above-described aspects of the present disclosure alone or in any combination. The brief summary presented above is intended to familiarize the reader with certain aspects and contexts of embodiments of the present disclosure without limitation to the claimed subject matter.

BRIEF DESCRIPTION OF THE DRAWINGS

The subject disclosure is further described in the following detailed description, and the accompanying drawings and schematics of non-limiting embodiments of the subject disclosure. The features depicted in the figures are not necessarily shown to scale. Certain features of the embodiments may be shown exaggerated in scale or in somewhat schematic form, and some details of elements may not be shown in the interest of clarity and conciseness. These and other features, aspects, and advantages of the present disclosure will become better understood when the following detailed description is read with reference to the accompanying drawings in which like characters represent like parts throughout the drawings, wherein.

DETAILED DESCRIPTION

Figure 1:
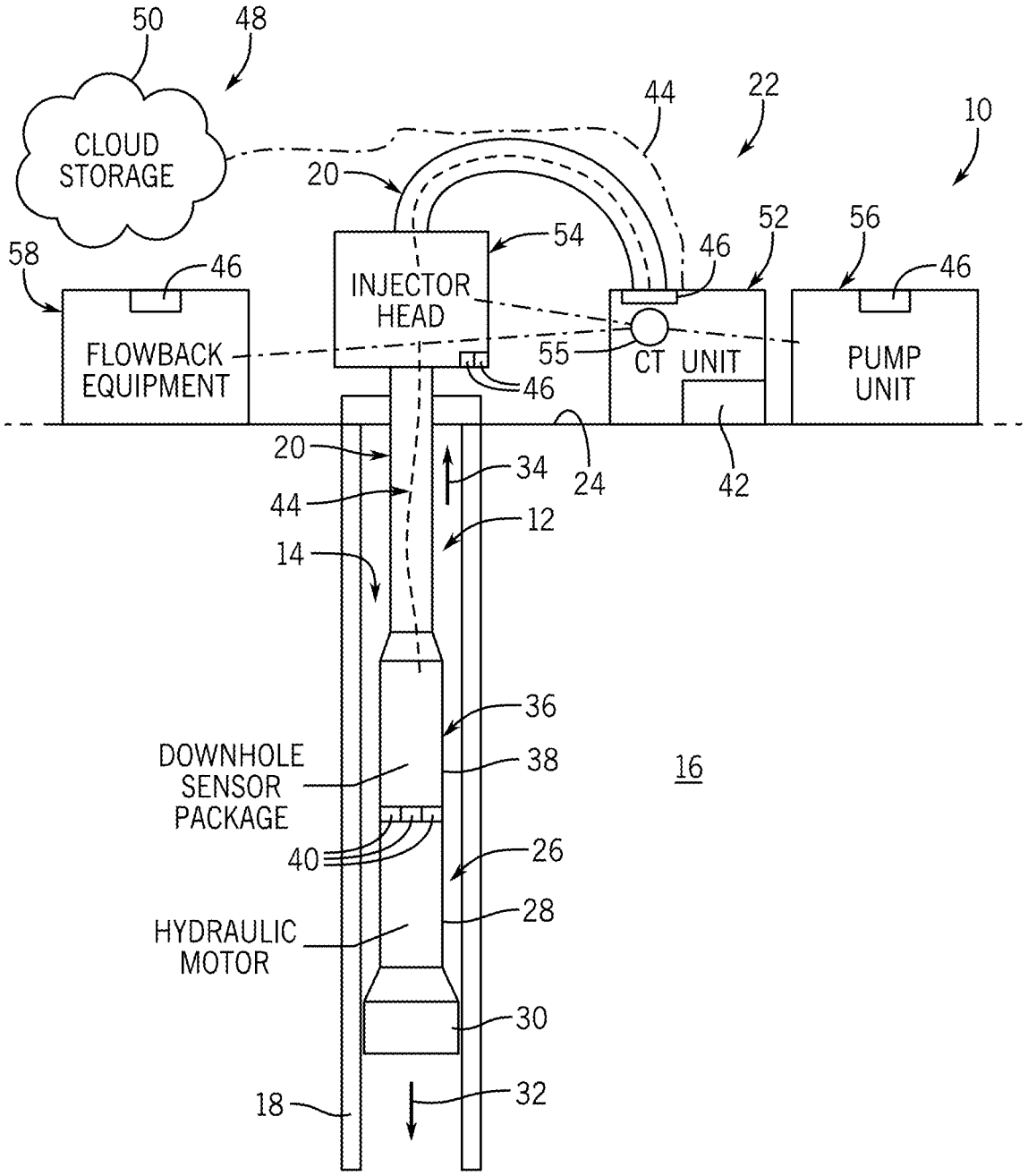
FIG. 1 illustrates a schematic diagram of a drilling/milling system, in accordance with embodiments of the present disclosure.

Certain embodiments commensurate in scope with the present disclosure are summarized below. These embodiments are not intended to limit the scope of the disclosure, but rather these embodiments are intended only to provide a brief summary of certain disclosed embodiments. Indeed, the present disclosure may encompass a variety of forms that may be similar to or different from the embodiments set forth below.

As used herein, the term "coupled" or "coupled to" may indicate establishing either a direct or indirect connection (e.g., where the connection may not include or include intermediate or intervening components between those coupled), and is not limited to either unless expressly referenced as such. The term "set" may refer to one or more items. Wherever possible, like or identical reference numerals are used in the figures to identify common or the same elements. The figures are not necessarily to scale and certain features and certain views of the figures may be shown exaggerated in scale for purposes of clarification.

As used herein, the terms "inner" and "outer"; "up" and "down"; "upper" and "lower"; "upward" and "downward"; "above" and "below"; "inward" and "outward"; and other like terms as used herein refer to relative positions to one another and are not intended to denote a particular direction or spatial orientation. The terms "couple," "coupled," "connect," "connection," "connected," "in connection with," and "connecting" refer to "in direct connection with" or "in connection with via one or more intermediate elements or members."

In addition, as used herein, the terms "real time", "real-time", or "substantially real time" may be used interchangeably and are intended to described operations (e.g., computing operations) that are performed without any human-perceivable interruption between operations. For example, as used herein, data relating to the systems described herein may be collected, transmitted, and/or used in control computations in "substantially real time" such that data readings, data transfers, and/or data processing steps occur once every second, once every 0.1 second, once every 0.01 second, or even more frequent, during operations of the systems (e.g., while the systems are operating). In addition, as used herein, the terms "automatic" and "automated" are intended to describe operations that are performed or caused to be performed, for example, by a processing system (i.e., solely by the processing system, without human intervention). In addition, as used herein, the term "approximately equal to" may be used to mean values that are relatively close to each other (e.g., within 5%, within 2%, within 1%, within 0.5%, or even closer, of each other).

Furthermore, when introducing elements of various embodiments of the present disclosure, the articles "a," "an," and "the" are intended to mean that there are one or more of the elements. The terms "comprising," "including," and "having" are intended to be inclusive and mean that there may be additional elements other than the listed elements. Additionally, it should be understood that references to "one embodiment," "an embodiment," or "some embodiments" of the present disclosure are not intended to be interpreted as excluding the existence of additional embodiments that also incorporate the recited features. Furthermore, the phrase A "based on" B is intended to mean that A is at least partially based on B. Moreover, unless expressly stated otherwise, the term "or" is intended to be inclusive (e.g., logical OR) and not exclusive (e.g., logical XOR). In other words, the phrase A "or" B is intended to mean A, B, or both A and B.

Certain terms are used throughout the description and claims to refer to particular features or components. As one skilled in the art will appreciate, different persons may refer to the same feature or component by different names. This document does not intend to distinguish between components or features that differ in name, but not function.

Current downhole operations in coiled tubing and well interventions are limited by tool complexity, lack of modularity, and inefficient control systems. These limitations hinder adaptability, increase operational time, and reduce the effectiveness of interventions in complex well environments.

The embodiments described herein introduce a modular, multi-functional downhole tool system that integrates hydraulic and electronic actuation, additive metering, orientation control, and intelligent pressure management. By combining these capabilities into a compact, stackable design, the system enhances operational flexibility, reduces tool string size, and enables precise, responsive interventions.

Unlike traditional downhole well tools that perform single functions and require separate systems for hydraulic and electric control, the embodiments described herein utilize a unified, modular platform. These embodiments allow for interchangeable actuation methods, integrated chemical delivery, and intelligent flow and pressure control, all within a customizable, stackable architecture that can be tailored to specific job requirements.

A modular downhole well tool system was invented that combines hydraulic and electric actuation, directional control, additive metering, and intelligent pressure management into a single, adaptable platform. The system enables more efficient, targeted, and responsive well interventions, especially in coiled tubing operations. Its stackable design allows for scalable functionality and integration with third-party components.

It will be appreciated that the modular actuation modules described herein are configured to be utilized in a "plug and play" manner in a stackable manner to enable the interchangeable actuation methods provided by the respective actuation modules. To that end, in certain embodiments, each of the modular actuation modules may include substantially identical mechanical attachment mechanisms (e.g., having substantially similar electrical wiring connections, hydraulic flow lines, and so forth) both at their upper (e.g., uphole) and lower (e.g., downhole) axial ends to facilitate the interchangeability between the various modular actuation modules within a single downhole well tool.

With the foregoing in mind, FIG. 1 illustrates a schematic diagram of an example drilling/milling system 10. As illustrated, in certain embodiments, a downhole tool string 12 may be run into a wellbore 14 that traverses a hydrocarbon-bearing formation 16 (i.e., reservoir). While certain elements of the drilling/milling system 10 are illustrated in FIG. 1, other elements of the drilling/milling system 10 (e.g., blowout preventers, wellhead "tree", etc.) may be omitted for clarity of illustration. In certain embodiments, the drilling/milling system 10 includes an interconnection of pipes, including vertical and/or horizontal casings 18, coiled tubing 20, and so forth, that connect to a surface facility 22 at the surface 24 of the drilling/milling system 10. In certain embodiments, the coiled tubing 20 extends inside the casing 18 and terminates at a tubing head (not shown) at or near the surface 24. In addition, in certain embodiments, the casing 18 contacts the wellbore 14 and terminates at a casing head (not shown) at or near the surface 24. Although described herein as using coiled tubing as the means of conveyance of the downhole tool string 12, in other embodiments, other means of conveyance such as other types of cables (e.g., wireline cables) may be used by the drilling/milling system 10.

In certain embodiments, a bottom hole assembly ("BHA") 26 may be run inside the casing 18 by the coiled tubing 20. As illustrated in FIG. 1, in certain embodiments, the BHA 26 may include a downhole motor 28 that operates to rotate a drilling/milling bit 30 (e.g., during drilling/milling operations) or other downhole well tools. In certain embodiments, the downhole motor 28 may be driven by hydraulic forces carried in fluid supplied from the surface 24 of the drilling/milling system 10. In certain embodiments, the BHA 26 may be connected to the coiled tubing 20, which is used to run the BHA 26 to a desired location within the wellbore 14. It is also contemplated that, in certain embodiments, the rotary motion of the drilling/milling bit 30 may be driven by rotation of the coiled tubing 20 effectuated by a rotary table or other surface-located rotary actuator. In such embodiments, the downhole motor 28 may be omitted.

In certain embodiments, the coiled tubing 20 may also be used to deliver fluid 32 to the drilling/milling bit 30 through an interior of the coiled tubing 20 to aid in the drilling/milling process and carry cuttings and possibly other fluid or solid components in return fluid 34 that flows up the annulus between the coiled tubing 20 and the casing 18 (or via a return flow path provided by the coiled tubing 20, in certain embodiments) for return to the surface facility 22. It is also contemplated that the return fluid 34 may include remnant proppant (e.g., sand) or possibly rock fragments that result from a hydraulic fracturing application, and flow within the drilling/milling system 10. Under certain conditions, fracturing fluid and possibly hydrocarbons (oil and/or gas), proppants and possibly rock fragments may flow from the fractured formation 16 through perforations in a newly opened interval and back to the surface 24 of the drilling/milling system 10 as part of the return fluid 34. In certain embodiments, the BHA 26 may be supplemented behind the rotary drill by an isolation device such as, for example, an inflatable packer that may be activated to isolate the zone below or above it and enable local pressure tests. In addition, in certain embodiments, the BHA 26 may include a tractor system that is capable of improving reach and WOB of the BHA 26 during CT operations.

As such, in certain embodiments, the downhole tool string 12 may include a downhole well tools 36 that are moved along the wellbore 14 via the coiled tubing 20. In certain embodiments, the downhole well tool(s) 36 may include a variety of drilling/milling/cutting tools and other types of downhole well tools. In the illustrated embodiment, the downhole well tool(s) 36 may include the drilling/milling bit 30, which may be powered by the downhole motor 28 (e.g., a positive displacement motor (PDM), or other hydraulic motor) of the BHA 26. In certain embodiments, the wellbore 14 may be an openhole wellbore or a cased wellbore defined by the casing 18. In addition, in certain embodiments, the wellbore 14 may be vertical or horizontal or inclined. It should be noted the downhole well tool(s) 36 may be part of various types of BHAs 26 coupled to the coiled tubing 20.

The downhole well tool(s) 36 of the downhole tool string 12 may include downhole tool modules including, but not limited to, a logging-while-drilling (LWD) module, a measuring-while-drilling (MWD) module, a rotary-steerable system (RSS), a drilling/milling bit 30, a motor for rotating the drilling/milling bit 30, and so forth. LWD involves measurement of one or more properties of a formation 16 during excavation of a wellbore 14, or shortly thereafter. MWD technology can provide for evaluation of physical properties such as one or more of pressure, temperature and bore trajectory in three-dimensional space, while extending a wellbore 14. RSS involves technology utilized for direction drilling/milling utilizing a drilling/milling bit 30.

As also illustrated in FIG. 1, in certain embodiments, the drilling/milling system 10 may include a downhole sensor package 38 having multiple downhole sensors 40. In certain embodiments, the sensor package 38 may be mounted along the downhole tool string 12, although certain downhole sensors 40 may be positioned at other downhole locations in other embodiments. In addition, in certain embodiments, downhole sensors 40 disposed on the coiled tubing 20 may be configured to detect downhole flow rates, downhole temperatures, and downhole pressures, and so forth, in the wellbore 14. In addition, in certain embodiments, downhole sensors 40 disposed on the casing 18 may be configured to detect downhole temperatures, downhole pressures, axial load (or "weight") and torque applied on the drilling/milling bit 30, casing collar locators (CCLs), resistivity, and so forth, in the wellbore 14.

In certain embodiments, data from the downhole sensors 40 may be relayed uphole to a surface processing system 42 (e.g., a computer-based processing system) disposed at the surface 24 and/or other suitable location of the drilling/milling system 10. In certain embodiments, the data may be relayed uphole in substantially real time (e.g., relayed while it is detected by the downhole sensors 40 during operation of the downhole well tool(s) 36) via a wired or wireless telemetric control line 44, and this real-time data may be referred to as edge data. In certain embodiments, the telemetric control line 44 may be in the form of an electrical line, fiber-optic line, or other suitable control line for transmitting data signals. In certain embodiments, the telemetric control line 44 may be routed along an interior of the coiled tubing 20, within a wall of the coiled tubing 20, or along an exterior of the coiled tubing 20. In addition, as described in greater detail herein, additional data (e.g., surface data) may be supplied by surface sensors 46 and/or stored in a memory location 48. By way of example, historical data and other useful data may be stored in the memory location 48 such as a cloud storage 50.

As illustrated, in certain embodiments, the coiled tubing 20 may be deployed from a CT reel 55 of a CT unit 52 and delivered downhole via an injector head 54. In certain embodiments, the injector head 54 may be controlled to slack off or pick up the coiled tubing 20 so as to control the tubing string weight and, thus, the weight-on-bit (WOB) acting on the drilling/milling bit 30 (or the downhole well tool(s) 36). In certain embodiments, the downhole well tool(s) 36 may be moved along the wellbore 14 via the coiled tubing 20 under control of the injector head 54 so as to apply a desired tubing weight and, thus, to achieve a desired rate of penetration (ROP) as the drilling/milling bit 30 is operated. Depending on the specifics of a given application, various types of data may be collected downhole, and transmitted to the surface processing system 42 in substantially real time to facilitate improved operation of the downhole well tool(s) 36. For example, as described in greater detail herein, the data may be used to fully or partially automate downhole operations, to optimize the downhole operations, and/or to provide more accurate predictions regarding components or aspects of the downhole operations.

In certain embodiments, fluid 32 may be delivered downhole under pressure from a pump unit 56. In certain embodiments, the fluid 32 may be delivered by the pump unit 56 through the downhole motor 28 to power the downhole motor 28 and, thus, the drilling/milling bit 30. In certain embodiments, the return fluid 34 is returned uphole, and this flow back of the return fluid 34 is controlled by suitable flowback equipment 58. In certain embodiments, the flowback equipment 58 may include chokes and other components/equipment used to control flow back of the return fluid 34 in a variety of applications, including well treatment applications.

As described in greater detail herein, the CT unit 52, the injector head 54, the pump unit 56, and the flowback equipment 58 may include advanced surface sensors 46, actuators, and local controllers, such as PLCs, which may cooperate together to provide sensor data to receive control signals from, and generate local control signals based on communications with, respectively, the surface processing system 42. In certain embodiments, as described in greater detail herein, the surface sensors 46 may include flow rate, pressure, and fluid rheology sensors 46, among other types of sensors. In addition, as described in greater detail herein, the actuators may include actuators for pump and choke control of the pump unit 56 and the flowback equipment 58, respectively, among other types of actuators.

In certain embodiments, surface sensors 46 of the CT unit 52 may be configured to detect positions of the coiled tubing 20, weights of the coiled tubing 20, and so forth. In addition, in certain embodiments, surface sensors 46 of the injector head 54 may be configured to detect wellhead pressure, and so forth. In addition, in certain embodiments, surface sensors 46 of the pump unit 56 may be configured to detect pump pressures, pump flow rates, and so forth. In addition, in certain embodiments, surface sensors 46 of the flowback equipment 58 may be configured to detect fluids production rates, solids production rates, and so forth.

Coiled tubing interventions often require manipulating the downhole tool string 12 while downhole. This manipulation can serve a variety of purposes, such as redirecting flow to a packer or orienting the downhole tool string 12 into a lateral drain. Conventionally, this manipulation is accomplished at the surface 24 through mechanical actuation (e.g., pushing and pulling on the coiled tubing) or hydraulic actuation (e.g., pumping fluid 32, dropping a ball, and so forth). Actuation from the surface 24 often requires relatively complex workflows, is prone to higher uncertainties, and lacks real control of downhole processes. Crew members usually have incomplete knowledge of what is happening because feedback may be somewhat limited. All of these limitations generate a higher risk when performing some of the most common applications, such as packer inflation, milling, or servicing multi-lateral wells.

Figure 2:
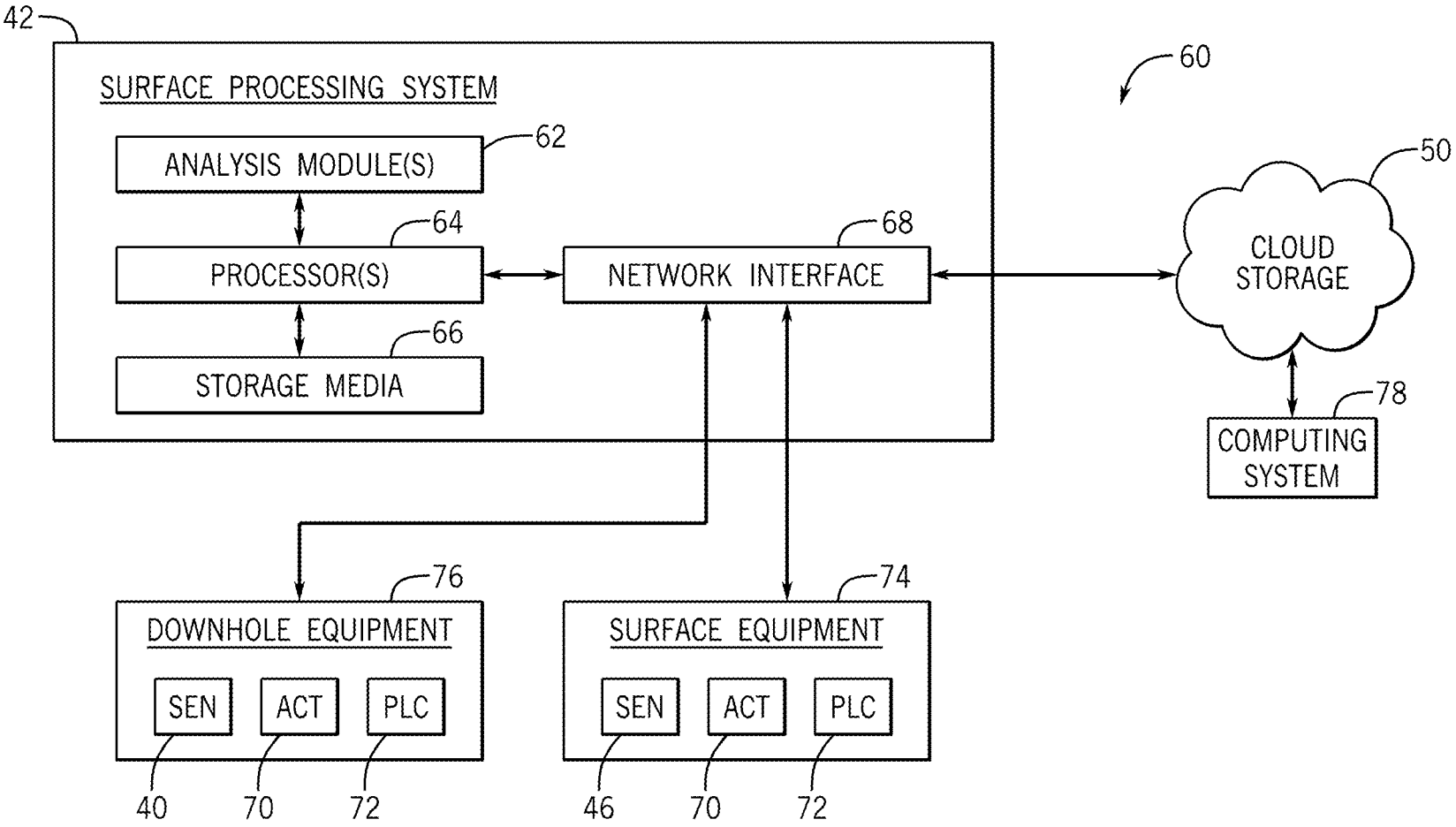
FIG. 2 illustrates a well control system that may include a surface processing system to control the drilling/milling system of FIG. 1, in accordance with embodiments of the present disclosure.

FIG. 2 illustrates a well control system 60 that may include a surface processing system 42 to control the drilling/milling system 10 of FIG. 1, as described in greater detail herein. In certain embodiments, the surface processing system 42 may include one or more analysis modules 62 (e.g., a program of computer-executable instructions and associated data) that may be configured to perform various functions of the embodiments described herein. In certain embodiments, to perform these various functions, the one or more analysis modules 62 may execute on one or more processors 64 of the surface processing system 42, which may be connected to one or more storage media 66 of the surface processing system 42. Indeed, in certain embodiments, the one or more analysis modules 62 may be stored in the one or more storage media 66.

In certain embodiments, the one or more processors 64 may include a microprocessor, a microcontroller, a processor module or subsystem, a programmable integrated circuit, a programmable gate array, a digital signal processor (DSP), or another control or computing device. In certain embodiments, the one or more processors 64 may include machine learning and/or artificial intelligence (AI) based processors. In certain embodiments, the one or more storage media 66 may be implemented as one or more non-transitory computer-readable or machine-readable storage media. In certain embodiments, the one or more storage media 66 may include one or more different forms of memory including semiconductor memory devices such as dynamic or static random access memories (DRAMs or SRAMs), erasable and programmable read-only memories (EPROMs), electrically erasable and programmable read-only memories (EEPROMs) and flash memories; magnetic disks such as fixed, floppy and removable disks; other magnetic media including tape; optical media such as compact disks (CDs) or digital video disks (DVDs); or other types of storage devices. Note that the computer-executable instructions and associated data of the analysis module(s) 62 may be provided on one computer-readable or machine-readable storage medium of the storage media 66, or alternatively, may be provided on multiple computer-readable or machine-readable storage media distributed in a large system having possibly plural nodes. Such computer-readable or machine-readable storage medium or media are considered to be part of an article (or article of manufacture), which may refer to any manufactured single component or multiple components. In certain embodiments, the one or more storage media 66 may be located either in the machine running the machine-readable instructions, or may be located at a remote site from which machine-readable instructions may be downloaded over a network for execution.

In certain embodiments, the processor(s) 64 may be connected to a network interface 68 of the surface processing system 42 to allow the surface processing system 42 to communicate with the multiple downhole sensors 40 and surface sensors 46 described herein, as well as communicate with the actuators 70 and/or PLCs 72 of the surface equipment 74 (e.g., the CT unit 52, the injector head 54, the pump unit 56, the flowback equipment 58, and so forth) and of the downhole equipment 76 (e.g., the BHA 26, the downhole motor 28, the drilling/milling bit 30, the downhole well tool(s) 36, and so forth) for the purpose of controlling operation of the drilling/milling system 10, as described in greater detail herein. In certain embodiments, the network interface 68 may also facilitate the surface processing system 42 to communicate data to the cloud storage 50 (or other wired and/or wireless communication network) to, for example, archive the data or to enable external computing systems 78 to access the data and/or to remotely interact with the surface processing system 42.

It should be appreciated that the well control system 60 illustrated in FIG. 2 is only one example of a drilling/milling system, and that the well control system 60 may have more or fewer components than shown, may combine additional components not depicted in the embodiment of FIG. 2, and/or the well control system 60 may have a different configuration or arrangement of the components depicted in FIG. 2. In addition, the various components illustrated in FIG. 2 may be implemented in hardware, software, or a combination of both hardware and software, including one or more signal processing and/or application specific integrated circuits. Furthermore, the operations of the well control system 60 as described herein may be implemented by running one or more functional modules in an information processing apparatus such as application specific chips, such as application-specific integrated circuits (ASICs), field-programmable gate arrays (FPGAs), programmable logic devices (PLDs), systems on a chip (SOCs), or other appropriate devices. These modules, combinations of these modules, and/or their combination with hardware are all included within the scope of the embodiments described herein.

The embodiments described herein introduce modular, multi-functional downhole well tools 36 that integrate hydraulic and electronic actuation, additive metering, orientation control, and intelligent pressure management. By combining these capabilities into a compact, stackable design, the downhole well tools 36 enhance operational flexibility, reduces tool string size, and enables precise, responsive interventions.

Unlike traditional downhole well tools that perform single functions and require separate systems for hydraulic and electric control, the embodiments described herein utilize a unified, modular platform. These embodiments allow for interchangeable actuation methods, integrated chemical delivery, and intelligent flow and pressure control, all within a customizable, stackable architecture that can be tailored to specific job requirements.

A modular downhole well tool system was invented that combines hydraulic and electric actuation, directional control, additive metering, and intelligent pressure management into a single, adaptable platform. The system enables more efficient, targeted, and responsive well interventions, especially in coiled tubing operations. Its stackable design allows for scalable functionality and integration with third-party components.

It will be appreciated that the modular actuation modules 80 described herein are configured to be utilized in a "plug and play" manner in a stackable manner to enable the interchangeable actuation methods provided by the respective actuation modules. To that end, in certain embodiments, each of the modular actuation modules 80 may include substantially identical mechanical attachment mechanisms (e.g., having substantially similar electrical wiring connections, hydraulic flow lines, and so forth) both at their upper (e.g., uphole) and lower (e.g., downhole) axial ends to facilitate the interchangeability between the various modular actuator modules 80 within a single downhole well tool 36.

Figure 3:
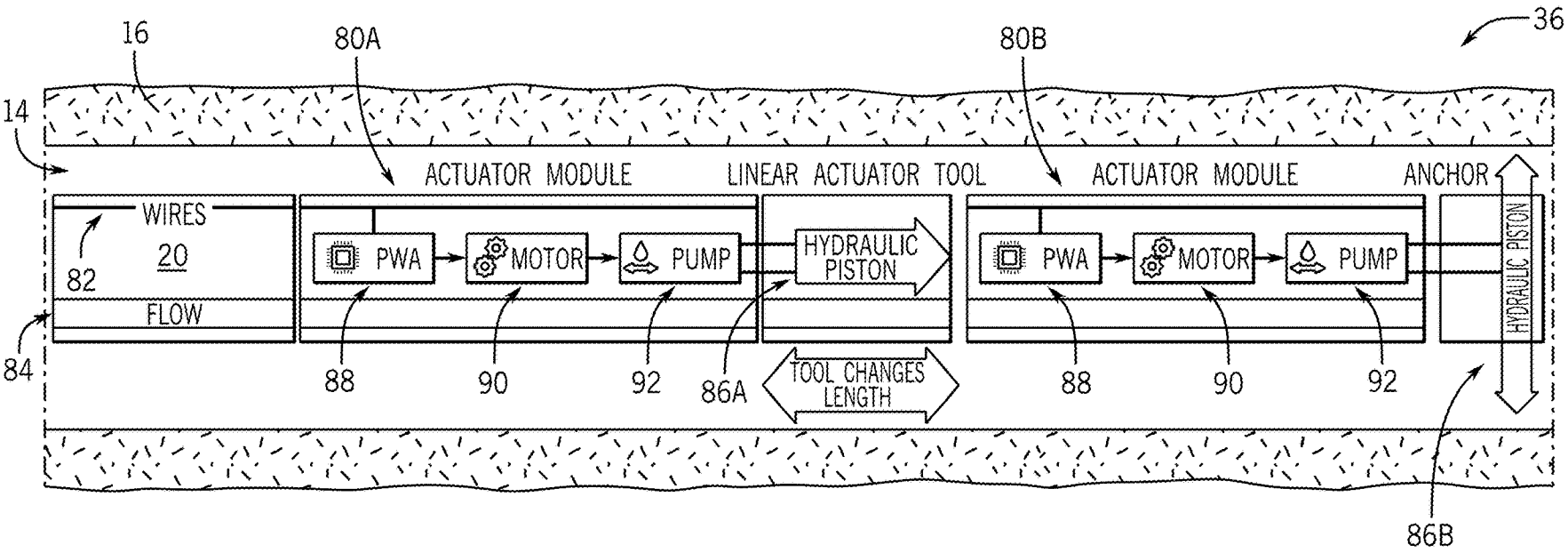
FIG. 3 illustrates a first example of a downhole well tool that includes multiple actuator modules stacked together along an axial length of the downhole well tool to greatly increase capabilities for a single coiled tubing job, in accordance with embodiments of the present disclosure.

FIG. 3 illustrates a first example of a downhole well tool 36 that includes multiple actuator modules 80 stacked together along an axial length of the downhole well tool 36 to greatly increase capabilities for a single coiled tubing job. As illustrated, as with most of the other embodiments described herein, electrical wires 82 and fluid flow paths 84 from uphole components (e.g., the coiled tubing 20 or other intermediate components) in the downhole tool string 12 may be connected to the components of the downhole well tool 36. The embodiment illustrated in FIG. 3 shows how multiple actuator modules 80 may be used within a single downhole well tool 36. In certain embodiments, the different actuator modules 80 may interact with each other (e.g., communicatively via their electrical wiring 82 and/or hydraulically via their fluid flow paths 84) either directly or indirectly, for example, via intermediate components of the downhole well tool 36. However, in other embodiments, the different actuator modules 80 need not necessarily interact with each other (e.g., either directly or indirectly, for example, via intermediate components of the downhole well tool 36) and may, in fact, perform drastically different tasks for the downhole well tool 36.

As illustrated in the embodiment of FIG. 3, in certain embodiments, two hydraulic pistons 86A, 86B may be used together. In this fashion, a tractor could pull the tool string 12 downhole. As illustrated, in certain embodiments, both of the actuator modules 80 may include a printed wiring assembly (PWA) 88, a motor 90, and a bi-directional hydraulic pump 92 to control the positions of the respective hydraulic pistons 86A, 86B to enable (or block) fluid flow downhole through the downhole well tool 36. For example, as illustrated in FIG. 3, in certain embodiments, a first (e.g., uphole) hydraulic piston 86A (e.g., acting as a linear actuator tool) may be controlled by its respective actuator module 80A to enable (or block) a first flow of fluid downhole through the downhole well tool 36, and a second (e.g., downhole) hydraulic piston 86B may be controlled by its respective actuator module 80B to control the first flow of fluid to be distributed at an axial end of the downhole well tool 36 (e.g., as a hydraulic anchor, for example).

In certain embodiments, the pumps 92 of the actuator modules 80 may also include pressure relief valves to prevent excess pressure from building. As such, it will be appreciated that a single actuator module 80 may be used for both pressure control and shifting (e.g., of pistons 86A, 86B as well as other mechanical components, such as valves, and so forth). For example, in certain embodiments, the hydraulics of one actuator module 80 may be used for multiple tasks within the downhole well tool 36. In addition, utilizing bi-directional hydraulic pumps 92 allows for two separate activation paths. In certain embodiments, the bi-directional hydraulic pumps 92 may be used as a power source combined with solenoids in an attachment to perform more complex downhole well operations, for example, enabling more complicated outputs.

Figure 4:
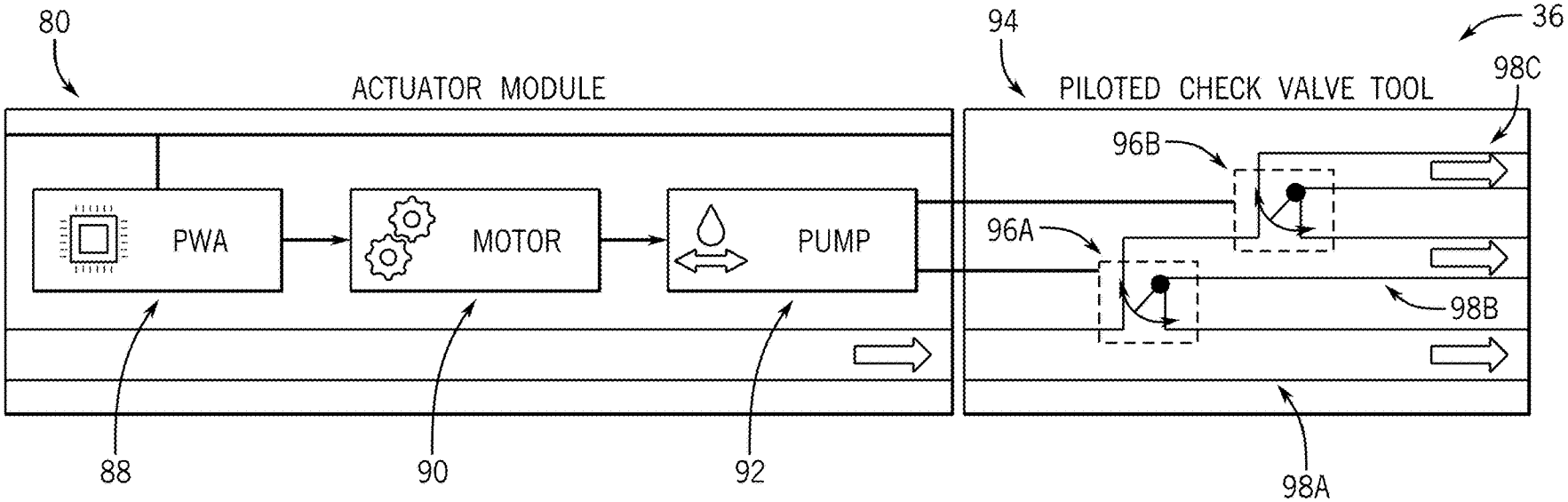
FIG. 4 illustrates another embodiment of a downhole well tool that includes an actuator module and a piloted check valve tool, in accordance with embodiments of the present disclosure.

FIG. 4 illustrates another embodiment of a downhole well tool 36 that includes an actuator module 80 (e.g., similar to the actuator modules 80 illustrated in FIG. 3) and a piloted check valve tool 94. As illustrated, the bi-directional hydraulic pump 92 of the actuator module 80 may be used to power a series pilot operated check valves 96A, 96B of the piloted check valve tool 94. The valves 96A, 96B may be piloted by the hydraulic oil from the bi-directional hydraulic pump 92. The piloted check valves 96A, 96B may then be used for redirecting flow from the surface 24 through the downhole well tool 36. In particular, as illustrated, in certain embodiments, a first piloted check valve 96A may split the main fluid flow into two fluid flows 98A, 98B and a second piloted check valve 96B may split the second fluid flow 98B into a third fluid flow 98C.

Figure 5:
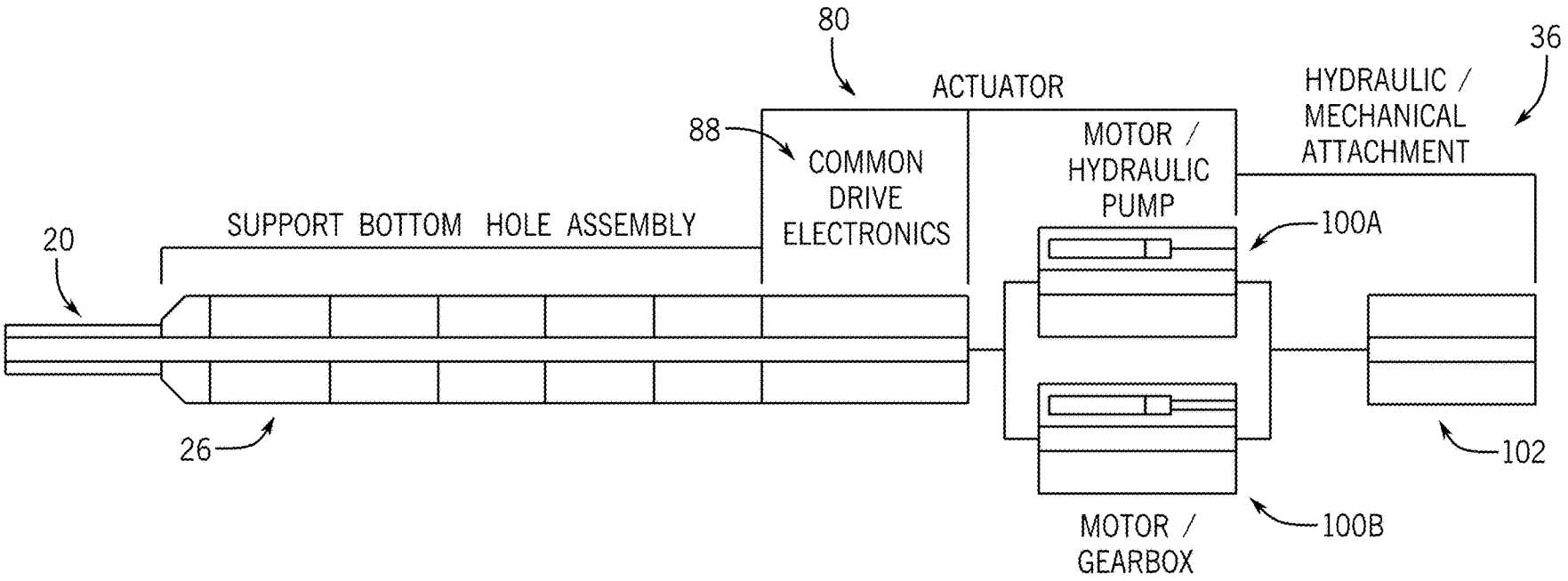
FIG. 5 illustrates another embodiment of a downhole well tool where the actuator electronic controls and the hydraulic components are modular to allow for use with either hydraulic or electrical actuation, in accordance with embodiments of the present disclosure.

FIG. 5 illustrates another embodiment of a downhole well tool 36 where the actuator electronic controls 88 (e.g., the PWA 88 discussed with reference to the embodiments illustrated in FIGS. 3 and 4) and the hydraulic components 100A, 100B (e.g., the motor 90 and the bi-directional hydraulic pump 92 in the embodiments illustrated in FIGS. 3 and 4) are modular to allow for use with either hydraulic or electrical actuation, depending on the needs of a particular coiled tubing job. For example, in certain embodiments, the hydraulic components 100A, 100B may include a motor/hydraulic pump combination 100A, whereas in other embodiments, the hydraulic components 100 may include a motor/gearbox combination 100B.

In certain embodiments, these different hydraulic components 100A, 100B may be interchangeable before deployment of the downhole well tool 36. In such embodiments, the hydraulic components 100A, 100B may be specifically configured to be directly coupled to the actuator electronic controls 88. Similarly, as illustrated, in such embodiments, the downhole well tool 36 may also include a hydraulic/mechanical attachment mechanism (e.g., end flow exit) 102 specifically configured to be directly coupled to the particular hydraulic components 100A, 100B. As such, similar to how the actuator modules 80 themselves are modular, as described in greater detail herein, the actuator electronic control components 88 and the hydraulic components 100A, 100B are modular to allow for use with hydraulic or electrical actuation. In other words, they are separate from each other so that they can be swapped out relatively easily within a particular downhole well tool 36. As such, it will be appreciated that the modular actuator electronic control components 88 and hydraulic components 100A, 100B may similarly have substantially identical mechanical attachment mechanisms (e.g., having substantially similar electrical wiring connections, hydraulic flow lines, and so forth) both at their upper (e.g., uphole) and lower (e.g., downhole) axial ends to facilitate the interchangeability between the various modular actuator electronic control components 88 and hydraulic components 100A, 100B within a single downhole well tool 36.

Figure 6:
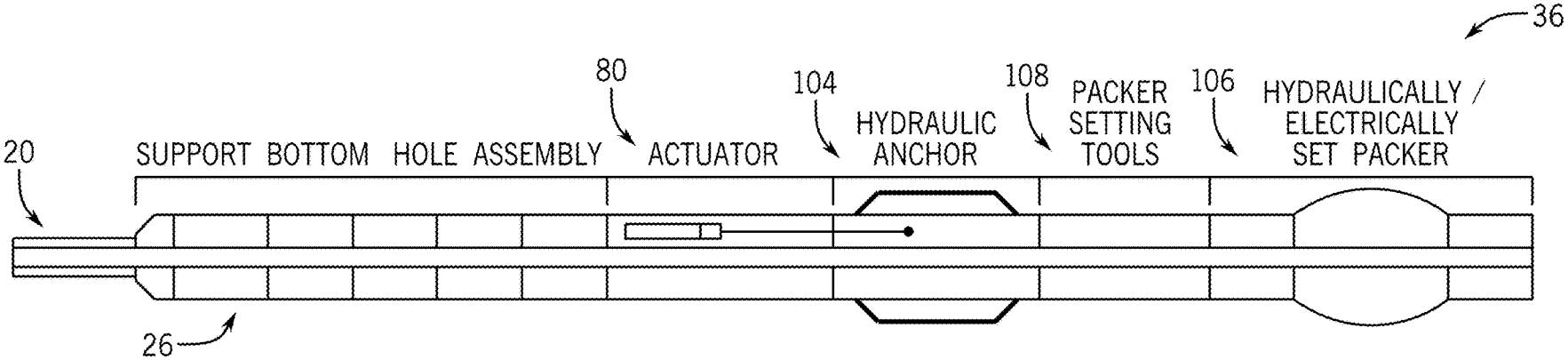
FIG. 6 illustrates one non-limiting example of the application of the modular actuator modules described herein, in accordance with embodiments of the present disclosure.

FIG. 6 illustrates one non-limiting example of the application of the modular actuator modules 80 described herein. In the illustrated embodiment, by combining a valve (e.g., associated with the modular actuator module 80, similar to the piloted check valve tool 94 discussed above with respect to the embodiment illustrated in FIG. 4), a hydraulic anchor 104, and either a cable packer or hydraulic packer 106 (e.g., which may be hydraulically set or electrically set by appropriate packer setting tools 108), the modularity of the downhole well tool 36 enables packers 106 from any and all manufacturers to be set using the downhole well tool 36. For example, the packer elements downhole from the downhole well tool 36 may be inflated, enabling operations that might otherwise not be possible.

Figure 7B:
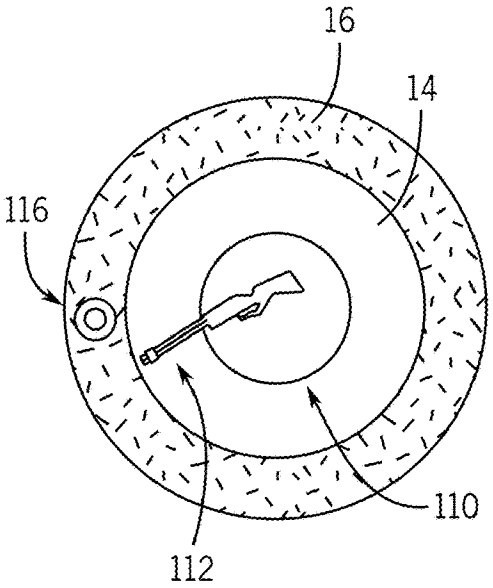
FIGS. 7A and 7B illustrate a side view and a cross-sectional view of another embodiment of a downhole well tool that utilizes a modular actuator module having a rotatable section configured to orient (e.g., rotate) the modular actuator module to ensure that certain features of the modular actuator module are oriented at a correct radial position with respect to a central axis of the respective downhole tool string, in accordance with embodiments of the present disclosure.
Figure 7A:
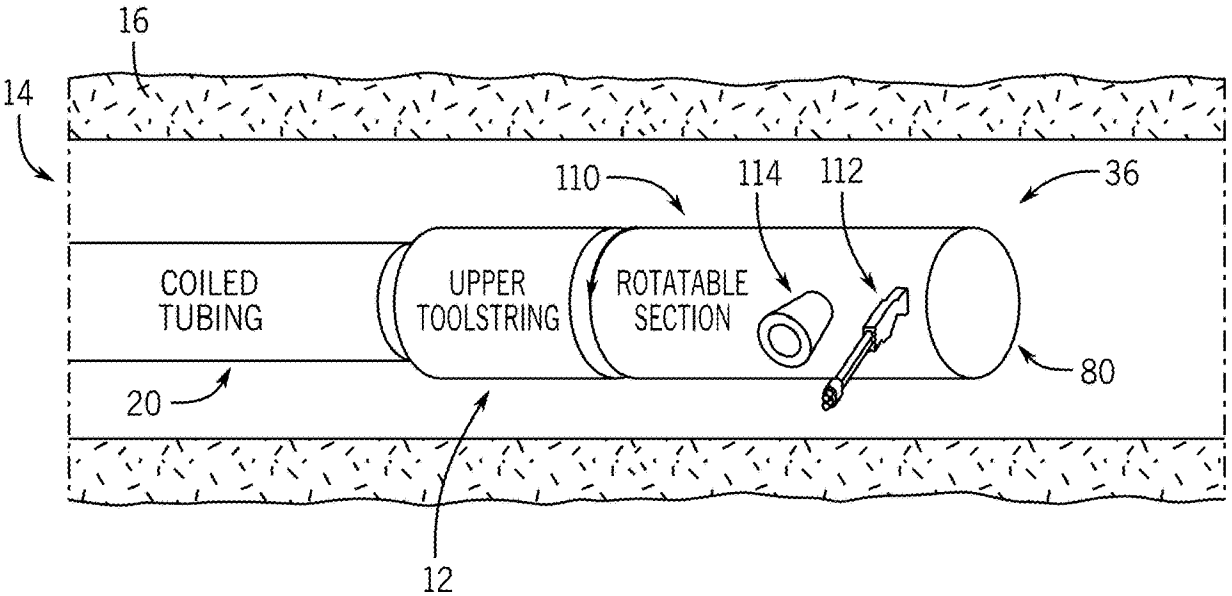

FIGS. 7A and 7B illustrate a side view and a cross-sectional view of another embodiment of a downhole well tool 36 that utilizes a modular actuator module 80 having a rotatable section 110 configured to orient (e.g., rotate) the modular actuator module 80 to ensure that certain features of the modular actuator module 80 are oriented at a correct radial position with respect to a central axis of the respective downhole tool string 12 (and of the modular actuator module 80) before a downhole well operation is performed by the downhole tool string 12 using the modular actuator module 80, as described in greater detail herein. For example, as illustrated in FIGS. 7A and 7B, in certain embodiments, the rotatable section 110 of the modular actuator module 80 may be rotated such that one or more perforation guns 112 and/or one or more high pressure nozzles 114 may be aimed at desired locations (e.g., targets) 116 within the surrounding formation 16 before respective perforation or other downhole well operations are performed using the modular actuator module 80 of the downhole tool string 12. Furthermore, in certain embodiments, not only the radial direction but also the inclination of the one or more perforation guns 112 and/or one or more high pressure nozzles 114 may be more accurately aimed at the desired locations (e.g., targets) 116 within the surrounding formation 16. In addition, in other embodiments, such orienting tools (e.g., direction and inclination tools) may be used in conjunction with various measurement tools (e.g., via wireline, and so forth), precisely directing where the measurements should take place. In certain embodiments, this could happen while pumping is happening, unlike conventional wireline logging jobs. Furthermore, for jobs that require higher degrees of accuracy, the ability to more precisely direct where measurements come from may be very beneficial.

Figure 8:
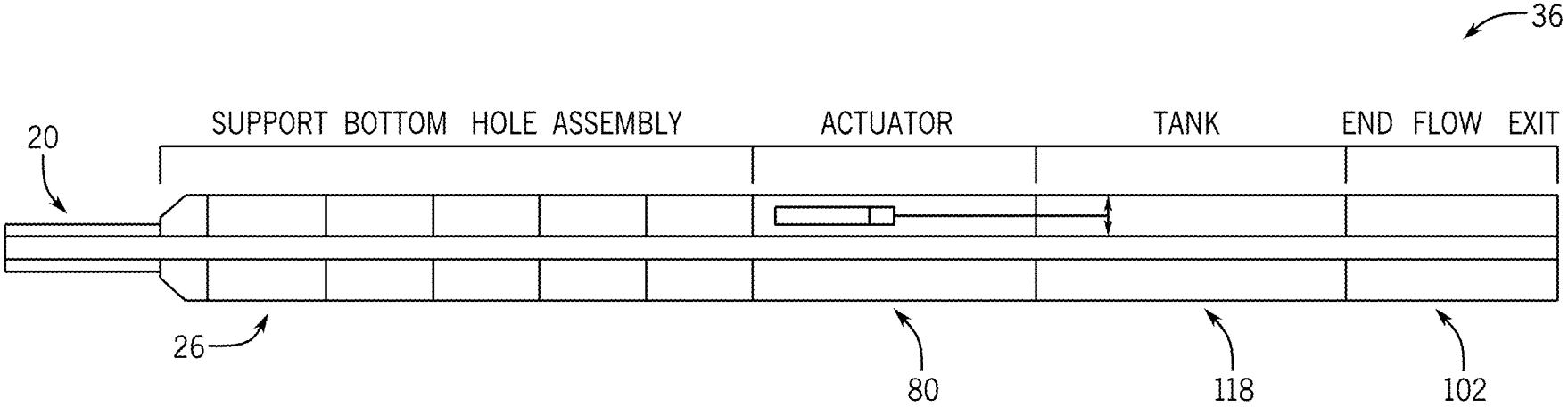
FIG. 8 illustrates another embodiment of a downhole well tool that includes a specialized chamber (e.g., tank) that is configured to provide (e.g., meter) various additives into the flow path within the downhole well tool and/or into the wellbore as needed, in accordance with embodiments of the present disclosure.
Figure 9:
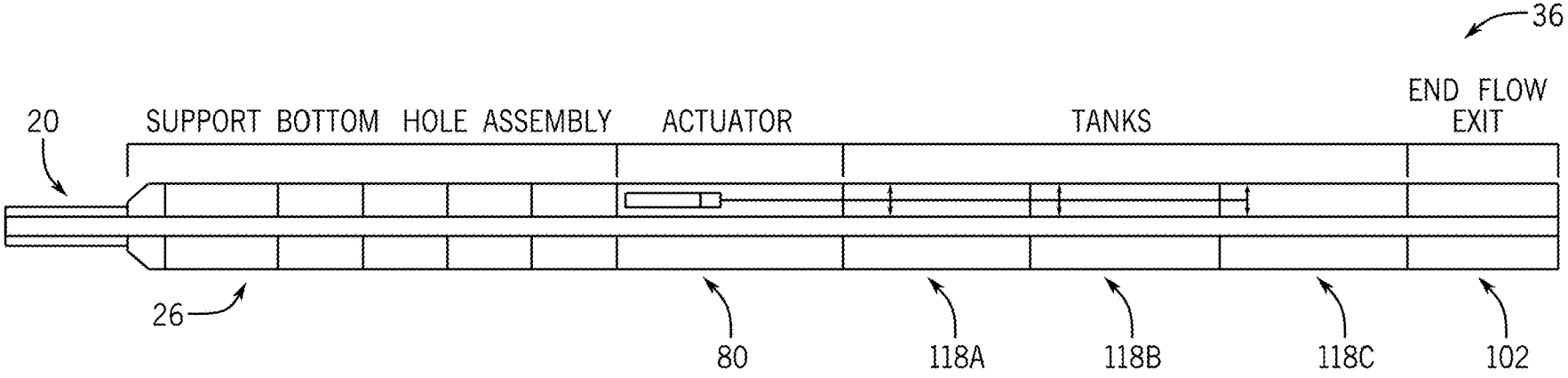
FIG. 9 illustrates yet another embodiment of a downhole well tool that is extended to use multiple chambers, in accordance with embodiments of the present disclosure.

FIG. 8 illustrates another embodiment of a downhole well tool 36 that includes a specialized chamber (e.g., tank) 118 that is configured to provide (e.g., meter) various additives into the flow path within the downhole well tool 36 and/or into the wellbore 14 and/or into the surrounding formation 16, as needed. It will be appreciated that the modular actuator module 80 may be capable of selectively controlling valves within the chamber 118 to ensure that appropriate flow rates and/or flow volumes of the additives are added into the flow path within the downhole well tool 36 and/or into the wellbore 14 as needed. For example, in certain embodiments, the additives may include activators for water shut-off or spotting surface friction reducers for extended reach. FIG. 9 illustrates yet another embodiment of a downhole well tool 36 that is extended to use multiple chambers 118A, 118B, 118C, for example, within which particular additives may be mixed to react on contact (e.g., via exothermic or endothermic reactions, for example), such as accelerators, activators, friction reducers, and so forth. Using embodiments similar to those illustrated in FIGS. 8 and 9 may facilitate the use of a hydraulically/electrically actuated circulation valve (e.g., such as the piloted check valve tool 94 illustrated in FIG. 4) in a coiled tubing drilling string to inject various fluids into the wellbore 14 and/or the surrounding formation 16 as needed by, for example, easily opening and shutting valves. Doing so may enable relatively precise introduction of such fluids into the wellbore 14 and/or the surrounding formation 16.

Figure 10:
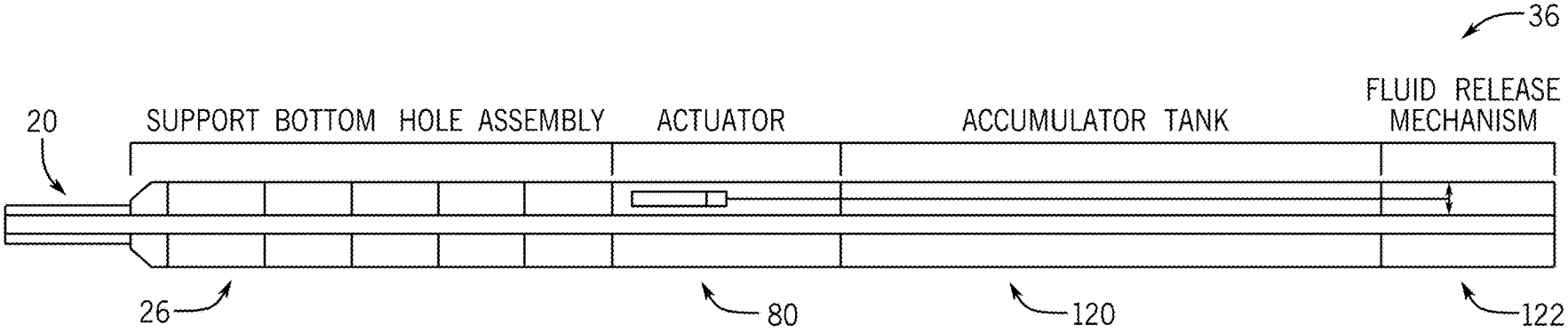
FIG. 10 illustrates yet another embodiment of a downhole well tool that includes a specialized chamber (e.g., accumulator tank) within which pressure charge may be stored with nitrogen/hydraulics, which may then be actuated to release high-velocity jets of fluid, in accordance with embodiments of the present disclosure.

FIG. 10 illustrates yet another embodiment of a downhole well tool 36 that includes a specialized chamber (e.g., accumulator tank) 120 within which pressure charge may be stored with nitrogen/hydraulics, which may then be actuated (e.g., via a specialized release mechanism 122 under control of the modular actuator module 80) to release high-velocity jets of fluid into the wellbore 14, the surrounding formation 16, or elsewhere. Depending on the configuration, the specialized chamber 120 may be considered an intelligent jar. In certain embodiments, the high-velocity jets may be directed in specific directions to prevent stuck conditions (e.g., when the downhole well tool 36 becomes stuck within the wellbore 14) in relatively troublesome wells. Traditionally, there are jars with spring-loaded activity. In contrast, the embodiments described herein may be capable of providing on-demand application of pressure that is built up within the downhole well tool 36.

Figure 11:
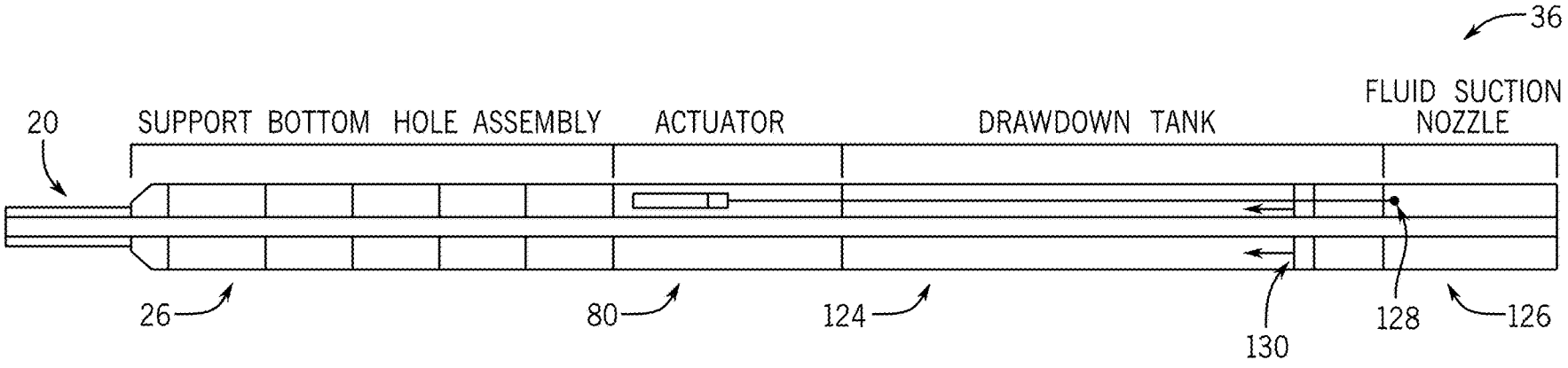
FIG. 11 illustrates yet another embodiment of a downhole well tool that includes a specialized chamber (e.g., drawdown tank) that has pressure drawn down, for example, by hydraulics/pumping mechanisms that may be suddenly opened up to create a vacuum, in accordance with embodiments of the present disclosure.

FIG. 11 illustrates yet another embodiment of a downhole well tool 36 that includes a specialized chamber (e.g., drawdown tank) 124 that has pressure drawn down, for example, by hydraulics/pumping mechanisms (e.g., similar to those discussed above with respect to the embodiments of the modular actuator modules 80 illustrated in FIGS. 3-5) that may be suddenly opened up to create a vacuum, for example, at a fluid suction nozzle 126. For example, as illustrated more specifically in FIG. 11, in certain embodiments, a rapid drawdown release mechanism 128 may be actuated by the modular actuator module 80 to enable one or more suction mechanisms 130 within the chamber 124 to create the vacuum at the fluid suction nozzle 126. Sometimes, after a milling operation is performed, not all of the debris is removed from within the wellbore 14. The embodiment illustrated in FIG. 11 would enable the creation of a vacuum and, perhaps, enable alternating between the vacuum and typical pumping, thereby potentially improving the ability of the downhole well tool 36 to remove the debris.

The foregoing description, for purpose of explanation, has been described with reference to specific embodiments. However, the illustrative discussions above are not intended to be exhaustive or to limit the disclosure to the precise forms disclosed. Many modifications and variations are possible in view of the above teachings. Moreover, the order in which the elements of the methods described herein are illustrated and described may be re-arranged, and/or two or more elements may occur simultaneously. The embodiments were chosen and described in order to best explain the principles of the disclosure and its practical applications, to thereby enable others skilled in the art to best utilize the disclosure and various embodiments with various modifications as are suited to the particular use contemplated.

Finally, the techniques presented and claimed herein are referenced and applied to material objects and concrete examples of a practical nature that demonstrably improve the present technical field and, as such, are not abstract, intangible or purely theoretical. Further, if any claims appended to the end of this specification contain one or more elements designated as "means for [perform]ing [a function] . . . " or "step for [perform]ing [a function] . . . ", it is intended that such elements are to be interpreted under 35 U.S.C. § 112(f). However, for any claims containing elements designated in any other manner, it is intended that such elements are not to be interpreted under 35 U.S.C. § 112(f).

The invention claimed is:

1. A downhole tool string, comprising:

a downhole well tool configured to perform one or more downhole well operations of a well system; and at least one modular actuator module mechanically coupled to the downhole well tool, wherein the at least one modular actuator module is configured to be removably decoupled from the downhole well tool to enable interchangeability with other modular actuator modules, wherein the at least one modular actuator module comprises:

modular actuator electronic control components configured to be removably decoupled from the downhole well tool to enable interchangeability with other modular actuator electronic control components; and modular hydraulic components configured to be removably decoupled from the downhole well tool to enable interchangeability with other modular hydraulic components, and wherein the at least one modular actuator module is configured to provide on-command actuation for the downhole well tool based on control signals received from a surface processing system located at a surface location of the well system to enable the downhole well tool to perform the one or more downhole well operations of the well system.

2. The downhole tool string of claim 1, wherein the at least one modular actuator module is configured to provide both pressure control and mechanical shifting actuation for the downhole well tool.

3. The downhole tool string of claim 1, comprising a plurality of modular actuator modules mechanically coupled to the downhole well tool and stacked along an axial length of the downhole well tool.

4. The downhole tool string of claim 3, wherein the plurality of modular actuator modules are configured to directly or indirectly interact with each other during performance of the one or more downhole well operations.

5. The downhole tool string of claim 1, wherein the modular hydraulic components comprise a bi-directional hydraulic pump and a motor, the bi-directional hydraulic pump configured to be actuated by the motor.

6. The downhole tool string of claim 1, wherein the at least one modular actuator module comprises an orienting mechanism configured to adjust a direction and/or inclination of at least one modular hydraulic component of the modular hydraulic components of the at least one modular actuator module relative to a target external to the downhole well tool.

7. The downhole tool string of claim 1, wherein the at least one modular actuator module is directly mechanically coupled to at least one specialized tank configured to provide one or more additives into a flow path relative to the downhole well tool.

8. The downhole tool string of claim 1, wherein the at least one modular actuator module is directly mechanically coupled to at least one accumulator tank within which pressure charge may be stored with nitrogen/hydraulics, and which may be actuated by the at least one modular actuator module to release high-velocity jets of fluid from the downhole well tool.

9. The downhole tool string of claim 1, wherein the at least one modular actuator module is directly mechanically coupled to at least one drawdown tank that has pressure drawn down, which may be opened up to create a vacuum relative to the downhole well tool.

10. The downhole tool string of claim 1, wherein the at least one modular actuator module is directly mechanically coupled to a valve assembly configured to be actuated by the at least one modular actuator module to provide one or more fluids relative to the downhole well tool on-command.

11. A downhole well tool, comprising:

at least one modular actuator module mechanically coupled to the downhole well tool, wherein the at least one modular actuator module is configured to be removably decoupled from the downhole well tool to enable interchangeability with other modular actuator modules, wherein the at least one modular actuator module comprises:

modular actuator electronic control components configured to be removably decoupled from the downhole well tool to enable interchangeability with other modular actuator electronic control components; and modular hydraulic components configured to be removably decoupled from the downhole well tool to enable interchangeability with other modular hydraulic components, and wherein the at least one modular actuator module is configured to provide on-command actuation for the downhole well tool based on control signals received from a surface processing system located at a surface location of a well system to enable the downhole well tool to perform one or more downhole well operations of the well system.

12. The downhole well tool of claim 11, wherein the at least one modular actuator module is configured to provide both pressure control and mechanical shifting actuation for the downhole well tool.

13. The downhole well tool of claim 11, comprising a plurality of modular actuator modules mechanically coupled to the downhole well tool and stacked along an axial length of the downhole well tool.

14. The downhole well tool of claim 13, wherein the plurality of modular actuator modules are configured to directly or indirectly interact with each other during performance of the one or more downhole well operations.

15. The downhole well tool of claim 11, wherein the modular hydraulic components comprise a bi-directional hydraulic pump and a motor, the bi-directional hydraulic pump configured to be actuated by the motor.

16. The downhole well tool of claim 11, wherein the at least one modular actuator module comprises an orienting mechanism configured to adjust a direction and/or inclination of at least one modular hydraulic component of the modular hydraulic components of the at least one modular actuator module relative to a target external to the downhole well tool.

17. A downhole tool string, comprising:

a downhole well tool configured to perform one or more downhole well operations of a well system; and a plurality of modular actuator modules mechanically coupled to the downhole well tool and stacked along an axial length of the downhole well tool, wherein each modular actuator module of the plurality of modular actuator modules is configured to be removably decoupled from the downhole well tool to enable interchangeability with other modular actuator modules, wherein at least one modular actuator module of the plurality of modular actuator modules comprises a bi-directional hydraulic pump configured to be actuated by a motor of the at least one modular actuator module, and wherein each modular actuator module of the plurality of modular actuator modules is configured to provide both pressure control and mechanical shifting actuation for the downhole well tool based on control signals received from a surface processing system located at a surface location of the well system to enable the downhole well tool to perform the one or more downhole well operations of the well system.

* * * * *